US009527628B1

(12) United States Patent
Santamaria

(10) Patent No.: US 9,527,628 B1
(45) Date of Patent: Dec. 27, 2016

(54) HYBRID ENVELOPE™

(76) Inventor: Fabricio Santamaria, Berkeley Heights, NJ (US)

( * ) Notice: Subject to any disclaimer, the term of this patent is extended or adjusted under 35 U.S.C. 154(b) by 472 days.

(21) Appl. No.: 13/507,987

(22) Filed: Aug. 10, 2012

(51) Int. Cl.
*B65D 27/06* (2006.01)
*B65D 27/14* (2006.01)

(52) U.S. Cl.
CPC ..... *B65D 27/06* (2013.01); *B65D 27/14* (2013.01)

(58) Field of Classification Search
CPC ..... B65D 27/00; B65D 27/06; B65D 27/14; B65D 27/16; B65D 27/18; B42D 5/025; B42D 5/026; B42D 15/08; B41L 1/32
USPC ..... 229/301–315
See application file for complete search history.

(56) References Cited

U.S. PATENT DOCUMENTS 1,635,278 A * 7/1927 Kaplan ..... 229/306
2,872,100 A 3/1959 Coffin
2,867,373 A 4/1959 Kaufmann
3,419,286 A * 12/1968 Noonan et al. ..... 229/69
3,905,545 A * 9/1975 Juszak et al. ..... 229/69
3,941,307 A * 3/1976 Van Malderghem ..... 229/69
3,981,435 A * 9/1976 Johnsen ..... 229/69
4,002,290 A * 1/1977 Van Malderghem ..... 229/69
4,039,122 A * 8/1977 Johnsen ..... 229/69
4,055,294 A * 10/1977 Traise ..... 229/69
4,157,759 A * 6/1979 Dicker ..... 229/301
RE30,114 E * 10/1979 Juszak et al. ..... 229/305
4,183,552 A * 1/1980 Webster ..... 462/1
4,384,670 A * 5/1983 Dicker ..... 229/69
4,418,865 A * 12/1983 Bowen ..... 229/69
4,624,481 A * 11/1986 Kercher ..... 462/6
4,632,427 A 12/1986 Angus
4,669,652 A * 6/1987 Seguin ..... 229/303
4,682,793 A * 7/1987 Walz ..... 462/2
4,715,531 A * 12/1987 Stewart et al. ..... 229/306
4,747,535 A * 5/1988 Haase et al. ..... 229/69
4,898,322 A * 2/1990 Coffey et al. ..... 229/69
4,923,112 A * 5/1990 Dale et al. ..... 229/69
4,960,237 A * 10/1990 Bendel ..... 229/305
5,104,036 A * 4/1992 Rutkowski et al. ..... 229/301
5,172,855 A * 12/1992 Coffey ..... 229/305
5,183,203 A * 2/1993 Sanders ..... 229/300
5,190,210 A * 3/1993 Walz ..... 229/69
5,238,183 A * 8/1993 Sauerwine ..... 229/304
5,290,225 A * 3/1994 Younger ..... 493/188
5,295,906 A * 3/1994 Skees ..... 462/18
5,341,985 A * 8/1994 Peterson ..... 229/305
5,429,298 A * 7/1995 Chess ..... 229/305
5,458,273 A * 10/1995 Schubert et al. ..... 229/304
5,513,795 A * 5/1996 Sauerwine ..... 229/305
D376,386 S * 12/1996 Sisilli ..... D19/1
D376,816 S * 12/1996 Sisilli ..... D19/1
5,607,738 A * 3/1997 Bishop ..... 229/92.1
5,626,551 A * 5/1997 Kearns et al. ..... 493/231
D382,896 S * 8/1997 Sisilli ..... D19/1
6,003,760 A * 12/1999 Abercrombie ..... 229/305

(Continued)

*Primary Examiner* — Peter Helvey
(74) *Attorney, Agent, or Firm* — Seth Natter; Natter & Natter

(57) ABSTRACT

A hybrid envelope in which an invoice can be inserted and removed. The hybrid envelope being reconfigurable into a reply envelope for receiving a remittance. The reply envelope appears like an ordinary envelope except for the lack of triangular sections usually found on most standard envelopes. Addresses are preprinted on the sides of the hybrid envelope.

2 Claims, 5 Drawing Sheets

(56) References Cited

U.S. PATENT DOCUMENTS

| | | | | |
|---|---|---|---|---|
| 6,027,014 | A * | 2/2000 | Cochran | 229/70 |
| 6,126,064 | A * | 10/2000 | Hutchinson | 229/92.1 |
| 6,431,437 | B1 * | 8/2002 | Lombardo et al. | 229/305 |
| 6,450,399 | B1 * | 9/2002 | Attia et al. | 229/68.1 |
| 6,460,760 | B1 * | 10/2002 | Sass | 229/305 |
| 6,561,547 | B2 * | 5/2003 | Attia et al. | 283/116 |
| 6,705,941 | B1 * | 3/2004 | van den Bergh | 462/26 |
| 6,966,484 | B2 | 11/2005 | Calonje | |
| 7,401,727 | B2 * | 7/2008 | Calonje et al. | 229/305 |
| 7,568,613 | B1 * | 8/2009 | Dillon et al. | 229/305 |
| 8,155,976 | B1 * | 4/2012 | Rendich et al. | 705/1.1 |
| 8,201,725 | B2 * | 6/2012 | Dyer | 229/305 |

* cited by examiner

HYBRID ENVELOPE™

FIELD OF THE INVENTION

The invention features a hybrid envelope containing an invoice and a configurable return envelope in which to provide a remittance, and more particularly to a more efficient hybrid envelope that is easy to use, and has less material than the average combination mailers now in use.

BACKGROUND OF THE INVENTION

It is well known that many combination envelopes feature multiple sheets. These envelopes attempt to combine two purposes-in-one. The combination mailer allows a business to send its invoices with an addressed return envelope disposed within one of the sheets of the mailer. This makes it convenient for the customers to promptly return payment.

A patent illustrating a business form with a mailing envelope is shown in U.S. Pat. No. 3,419,286, issued to G. D. Noonan et al, on Dec. 31, 1968. This patent teaches bonding several sheets together to provide an envelope combination that provides a business invoice and a reply envelope in which to mail back the remittance.

In order to achieve a multi-function, the envelope combination of the above-identified patent, features two tear-away side segments, and a top tear-away segment. These tear-away segments are required to remove the mailing address sheet in order to reveal an inside envelope with the company address, and an upper sheet that may contain an invoice.

In another multi-function, patented envelope issued to Kaufmann on Jan. 6, 1959; U.S. Pat. No. 2,867,373; a double envelope is illustrated. The two envelopes are shown extending diametrically opposite each other. The operation of the double envelope requires oppositely extending flaps and tabs. They are gummed for sealing the side pieces of each envelope. While this double envelope professes to be uncomplicated, the many folding sheets add to the complexity and expense of fabrication.

In yet another patented mailer and return envelope combination, issued to Angus, on Dec. 30, 1986; U.S. Pat. No. 4,632,427; a two-way envelope is depicted wherein a front and rear surface is formed of a single sheet. The return envelope is rendered from the main body containing invoice data by tearing it from the body along a line of separation. Perforated strips along the sides of the mailer allow the mailer to be opened.

In still a further patented mailer and return envelope combination, as shown in U.S. Pat. No. 5,104,036; issued on Apr. 14, 1992, to Rutkowski et al, a double envelope is opened by side edge strips. The object of the mailer combination is to provide two sheets of uniform thickness. One of the sheets can be folded to provide a transmittal envelope. The end of the sheet detaches from the remaining portion to provide a reply envelope.

Observing the many different designs of similar envelopes, one realizes that there are many combination envelopes claiming to provide a special advantage.

The present invention seeks to provide a hybrid envelope having one-third less material than ordinary mailers, and which has an easier approach to finding an invoice, and inserting a reply check.

Using less material realizes a great saving in the manufacture of the envelope.

Simplifying the process of obtaining the invoice and inserting a reply check enhances the functionality of the hybrid envelope.

The Hybrid Envelope™ of the current invention features an upper portion, and a lower portion. A company using this envelope mailer tucks its invoice beneath inwardly folded flaps disposed about a peripheral margin zone of the upper portion. The lower portion of the hybrid envelope comprises a release strip covering an adhesively coated peripheral margin zone. The margin zone release strip can be peeled from either the left, or the right side of the center line disposed between the upper and lower portions, respectively. This, gives deference to right, or left handed users.

Peeling the margin zone release strip, exposes the adhesive surface formed about the peripheral margin zone of the lower portion. This adhesive surface allows the lower portion to be folded along the center line, and the peripheral margin zones of the lower portion to become adhered to the peripheral margin zones of the upper portion. The lower portion contains on its back side, the address for the customer in the center thereof. The company's return address is disposed in the corner of the envelope on the left hand side. On the right, is a place to apply appropriate postage. The hybrid envelope is now ready to be mailed to the customer.

Upon receipt of the hybrid envelope, the customer will notice that the peripheral margin zones on the top and side sections of the envelope can be torn away. The recipient will proceed to remove the peripheral margin zones. The hybrid envelope will now unfold into two halves, revealing the invoice tucked beneath the inwardly folded flaps of the upper half. The invoice can be removed, revealing a company remittance address on the inside of the upper half.

Folding the lower portion backwardly along the center line, and unfolding the flaps on the upper portion will provide a reply envelope in which a check can be inserted in response to the invoice. The unfolded flaps contain adhesive covered by a release strip on the outside. After the release strips have been removed, the unfolded flaps can now be folded in the opposite direction over the backwardly folded lower portion to seal the check inside, against the upper portion. The envelope thus formed, now only requires a stamp to send it back to the company.

The above mailer saves paper. The present return envelope is configured by existing sheet materials within the envelope combination, and does not rely upon having a full internal return envelope disposed inside. In addition, the configured return envelope is devoid of expensive triangular sealing sections that are part of a standard envelope. This is a big saving in manufacturing cost.

The fact that the return address is already printed on the envelope, provides the advantage that the responder does not need to worry about cellophane windows having the proper orientation of a reply invoice address.

SUMMARY OF THE INVENTION

The invention features a hybrid envelope mailer containing an invoice and a configurable reply envelope in which to provide a remittance check. The mailer appears like an ordinary envelope when received, except for triangular side sections seen on ordinary envelopes. Upon receipt of the hybrid envelope, the customer will notice that the envelope has peripheral margin zones on the top and side sections of the envelope. The recipient will proceed to remove the peripheral margin zones. The hybrid envelope will now unfold into two halves, revealing the invoice tucked beneath the inwardly folded flaps of the upper half. The invoice can be removed, revealing a company remittance address on the inside of the upper half.

Folding the lower portion backwardly along the center line, and opening the flaps on the upper portion will provide a reply envelope in which a check can be inserted in response to the invoice. The flaps which contain adhesive on the outside, can now be backwardly folded over the backwardly folded lower portion to seal the check inside, against the upper portion. The envelope thus formed, now only requires a stamp to send it back to the company.

It is an object of this invention to provide an improved combination invoice and reply mailer.

It is still another object of this invention to reduce the amount of material in a combination mailer and reply envelope by approximately one-third, in order to provide a less expensive envelope combination.

It is yet another object of this invention to provide a combination invoice and reply envelope that lacks expensive triangular pieces.

It is a further object of the invention to provide an invoice mailer that configures a reply envelope from the sections of the envelope, by reversing the envelope sections.

ELEMENTS OF THE INVENTION

1. Hybrid Envelope™
2. Invoice
5. Upper portion
6. Lower portion
7. Margin zone release strip
8. Center line
9. Adhesive surface
11. Back side
12. Customer Address
14. center of back side of upper portion
15. company's return address
16. postage corner of envelope
17, 18,& 19,17*a*, 18*a* & 19*a*. Margin Zones
20. top of envelope
21. & 22. Side sections of envelope
23., 24., & 25. Internal flaps.
26. company remittance address
27. adhesive coating on flaps
28. flap release strips
29. arrow
30. reply envelope
31. arrow
33. check

BRIEF DESCRIPTION OF THE DRAWINGS

The following descriptions of the drawings are to be used in conjunction with the subsequent description of the invention contained in the preferred embodiment. A better understanding of invention will become more apparent with reference to the subsequent figures, in which.

DESCRIPTION OF THE PREFERRED EMBODIMENT

Generally speaking, the invention features a Hybrid Envelope™ containing a structure for inserting an invoice. The Hybrid Envelope™ and a configurable reply envelope for sending a remittance. The Hybrid Envelope™ appears like an ordinary envelope except for the lack of triangular sections disposed upon standard envelopes. The Hybrid Envelope™ has the recipient's address preprinted thereupon.

Figure 1:
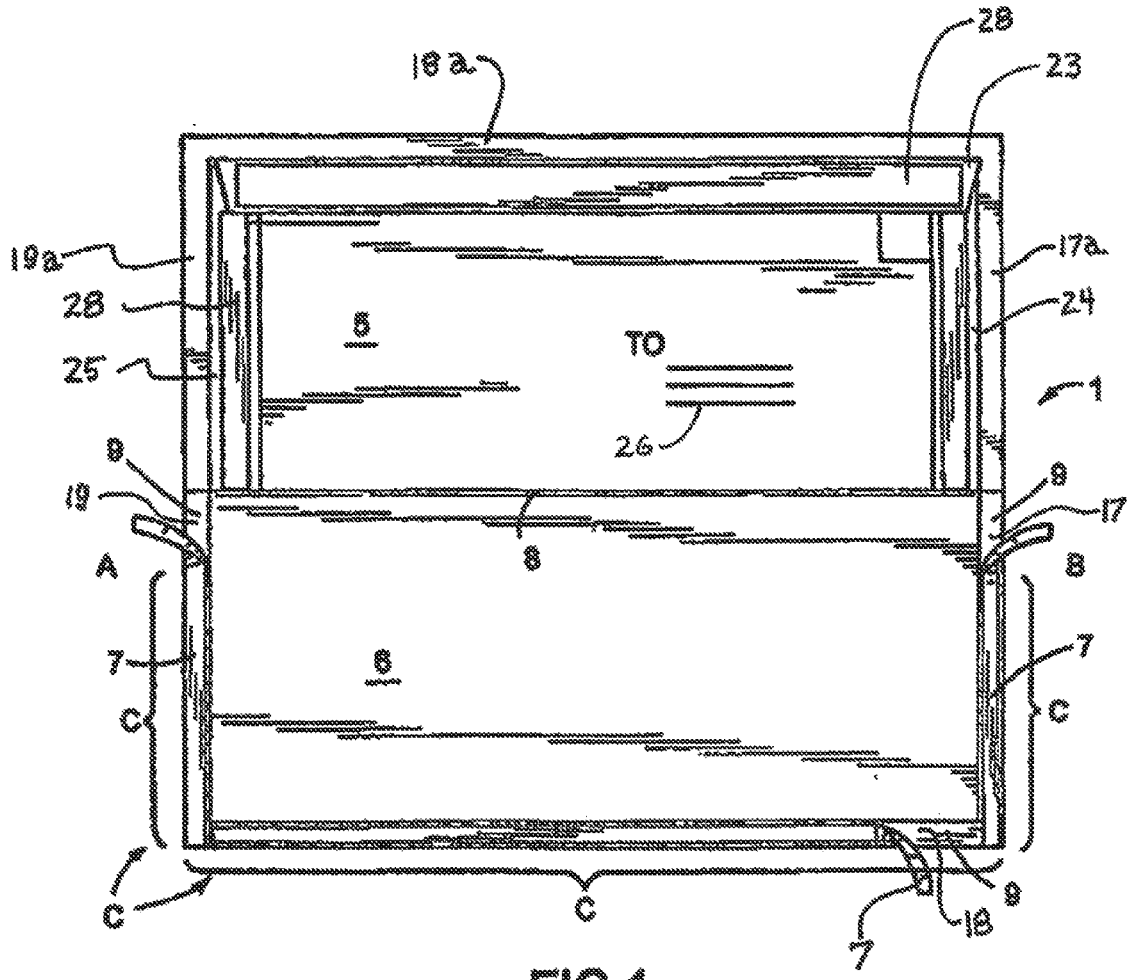
FIG. 1 illustrates the invoice receiving face of the mailer of this invention.
Figure 2:
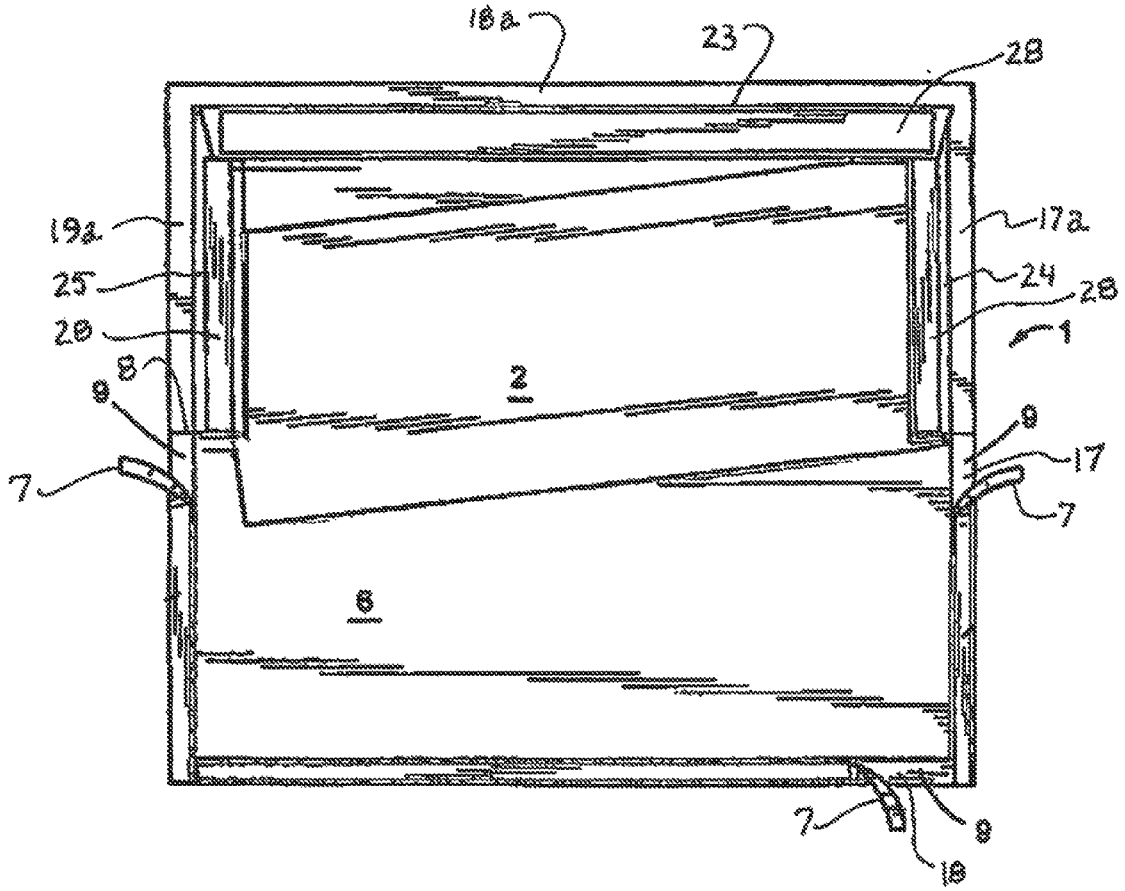
FIG. 2 depicts the mailer of FIG. 1, with a company invoice being placed therein.

Referring to FIGS. 1 and 2, The hybrid envelope of this invention, is illustrated. As illustrated in FIG. 2, company using this hybrid envelope 1 tucks its invoice 2 beneath inwardly folded flaps 23, 24 and 25 disposed adjacent peripheral margin zones 17*a*,18*a*,19*a* of an upper rectangular portion 5. A lower rectangular portion 6 of the hybrid envelope 1 shown in FIG. 1, comprises a release strip 7 disposed adjacent its outer periphery C. The release strip 7 can be peeled from either the left side A or the right side B of the center fold line 8. The center fold line 8 is disposed between the upper 5 and lower 6 portions, respectively. This, gives deference to right, or left handed users.

Figure 3:
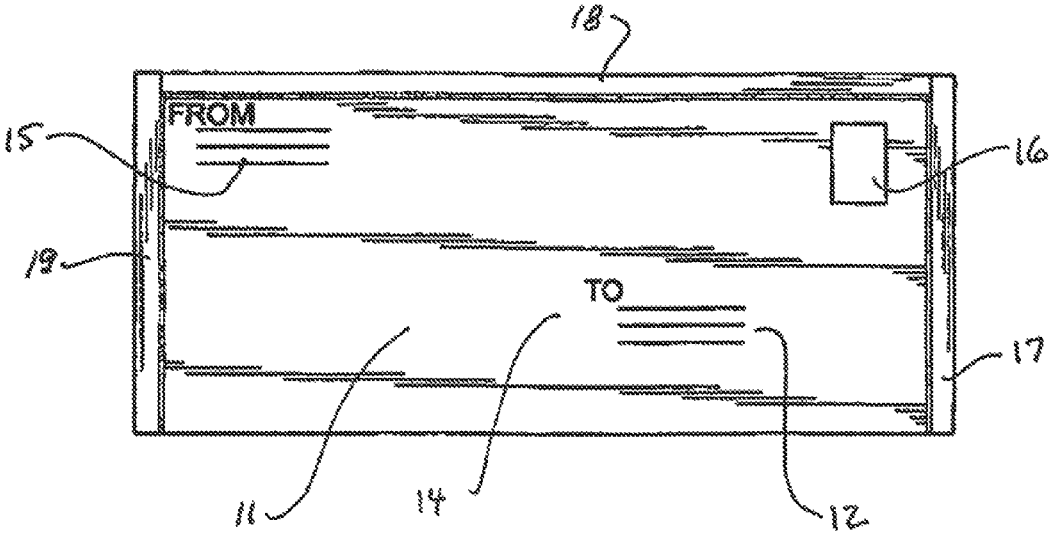
FIG. 3 shows a view of the mailer ready for postage and mailing after the invoice has been sealed inside.

Pulling the release strip 7, exposes an adhesive surface 9 coated on the margin zones 17, 18, 19 of the lower portion 6. This adhesive surface 9 allows the lower portion 6 to be folded along the center fold line 8, and the margin zones 17, 18, 19 to become registered with and adhered to the corresponding uncoated margin zones 17*a*, 18*a*. 19*a* of the upper portion 5. The lower portion 6 contains on its back side 11, the address 12 for the customer in the center 14 as shown in FIG. 3. The company's return address 15 is disposed in the upper left corner of the side 11. In the right corner, is a place for postage 16. The hybrid envelope 1, is now ready to be mailed to the customer as depicted in FIG. 3.

Figure 4:
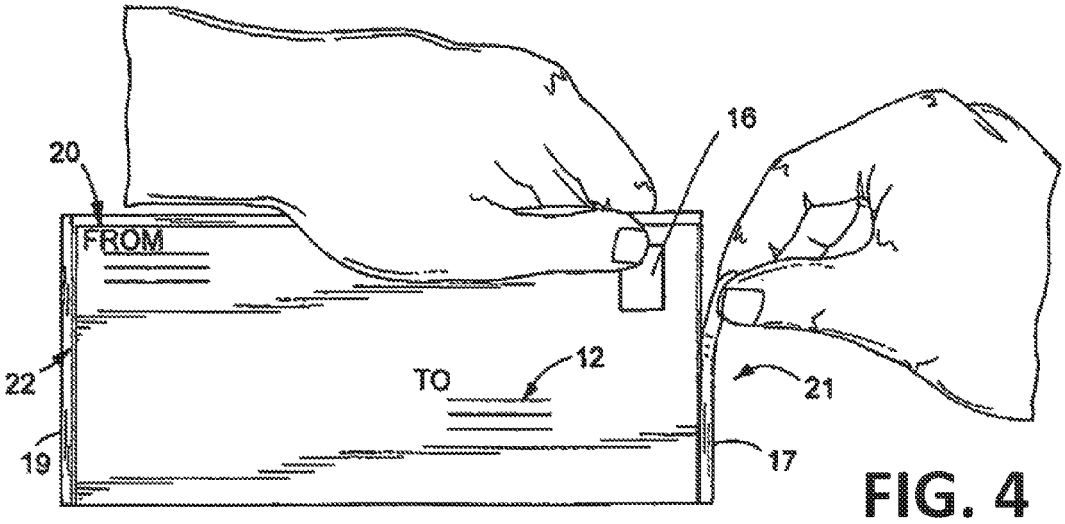
FIGS. 4 and 5 depict the mailer shown in FIG. 3, with peripheral margin zones being torn away to open the mailer.
Figure 5:
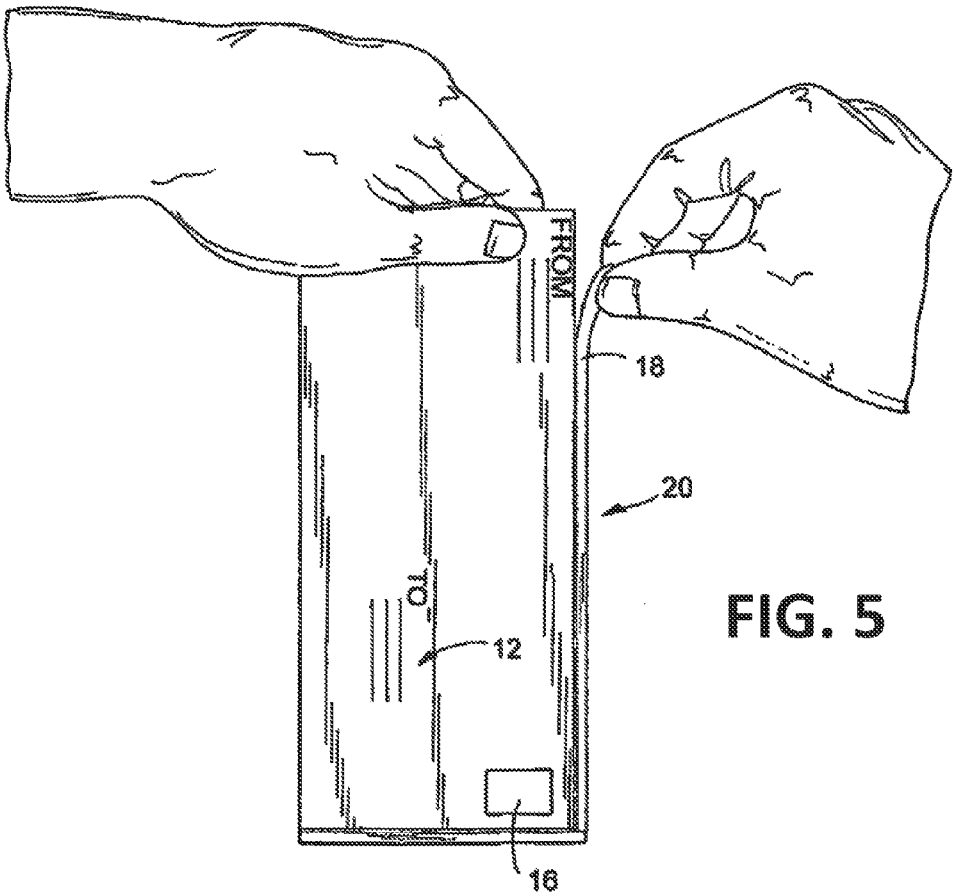

Referring to FIGS. 4 and 5, the customer upon receipt of the hybrid envelope 1, will notice that the margin zones 17,17*a*, 18,18*a*,19 and 19*a*, may be torn off along the top 20, and side sections 21 and 22, respectively, of hybrid envelope 1. The recipient will proceed to discard the torn margin zones 17,17*a*, 18,18*a*, and 19,19*a* respectively. The hybrid envelope 1, will now unfold thus revealing the invoice 2 tucked beneath the inwardly folded flaps 23, 24, and 25, respectively. The invoice 2 can be removed, revealing a company remittance address 26 on the inside of the upper portion 5.

Figure 6:
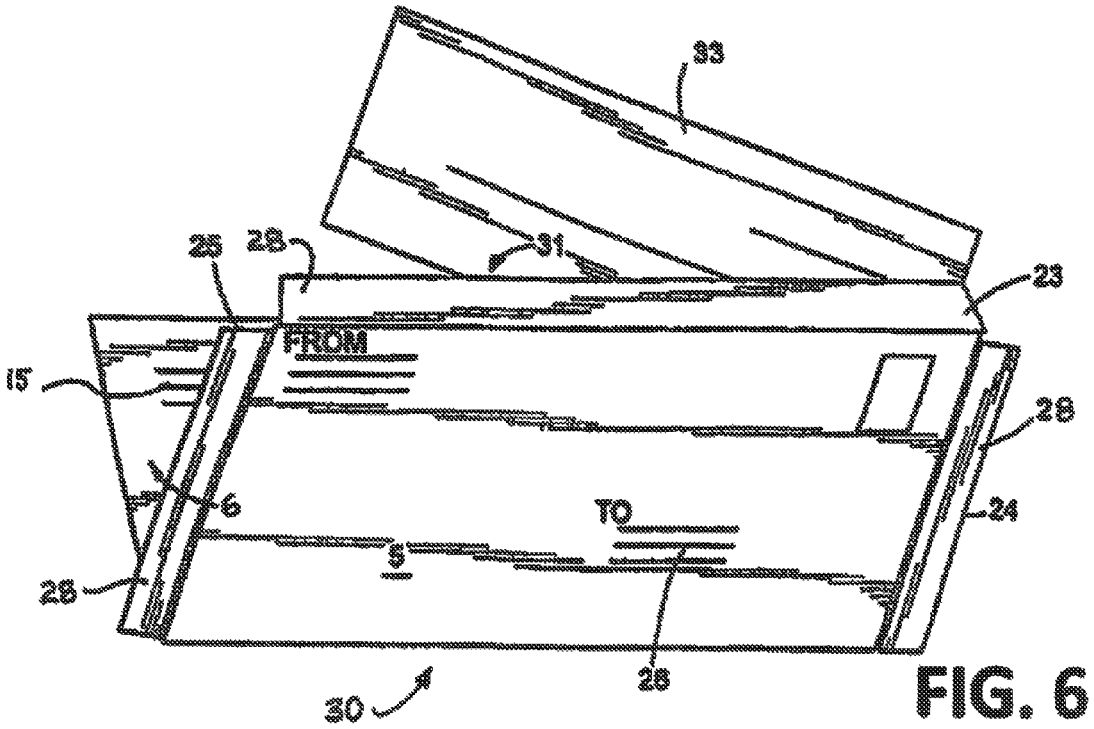
FIG. 6 depicts an isometeric view of the mailer wherein the lower portion is being folded backwardly toward the upper portion and the invoice retaining inwardly folded flaps have been unfolded to form a receptacle for a reply check being inserted therebetween.
Figure 7:
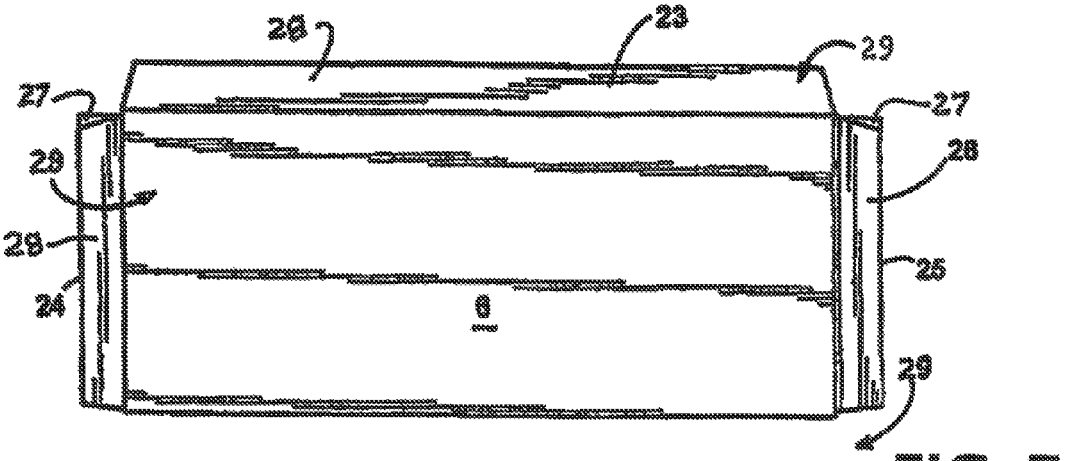
FIG. 7 shows a back view of the reconfigured mailer with adhesive coated unfolded flaps to be folded in the opposite direction after the release strips have been removed to complete a reply envelope

Referring to FIGS. 6 and 7, the lower portion 6 is backwardly folded along the center fold line 8, and opening the inwardly folded flaps 23, 24, and 25, respectively, on the upper portion 5 will provide a reply envelope 30 in which a check 33 can be inserted (arrow 31) in response to the invoice 2. The flaps 23, 24, and 25, contain an adhesive coating 27 covered by flap release strips 28. After exposing the adhesive coating 27 by removing the release strips 28, the flaps 23, 24, 25 can now be folded in the opposite direction (arrow 29) and adhered to the lower portion 6. The reply envelope 30 thus formed, with the remittance check 33 inside, now only requires a stamp to send it back to the company.

In configuring the reply envelope, the steps are a reversal of configuring the invoice envelope. The materials are essentially the same, and there is a large saving in time and materials.

Configuring a remittance envelope out of existing sheet portions of the Hybrid Envelope™, saves paper, plus it does away with expensive, triangular sealing portions common to ordinary envelopes. This provides a more efficient and inexpensive mailer and remittance combination.

It should be obvious, that the invention as described herein supports multiple uses to which the mailer system can be applied. By way of example, it may be employed not only for forwarding invoices, bills, statements or other requests for payment, but for forwarding any document to a recipient in situations wherein a reply or response document is requested be returned by the recipient.

Changes that are within the purview of reasonable men and skilled practitioners of this art are deemed to be encompassed within the invention by the scope intended by the description.

Having thus described the invention, what is desired for protection by Letters Patent is presented in the subsequently appended claims.

What is claimed is:

1. An envelope that evolves into a reply envelope comprising a quadrilateral sheet with opposite sides of equal length, a portion fold line which divides the sheet into a rectangular first portion and a rectangular second portion, a margin zone bordering three sides of each portion, the fold line comprising a fourth side of each portion, the first portion including flaps having flap fold lines spaced inwardly of the first portion margin zones, the first portion having a first face with reply address indicia positioned thereon, the portions being folded together along the portion fold line with a separate sheet comprising a document being tucked between each flap and the first face of the first portion, the document overlying the reply address indicia, the document being covered by a first face of the second portion, the margin zones of one of the portions being coated with an adhesive covered by a release strip, the release strip being removed to adhere the margin zones of the first portion to the margin zones of the second portion for mailing to a recipient, recipient address indicia being positioned on a second face of the second portion, the adhered margin zones being removable to unfold the portions about the portion fold line and remove the document, the portions being foldable in the opposite direction about the portion fold line to expose the reply address indicia on the first face of the first portion and configure a reply envelope for enclosing a reply document, the flaps including an adhesive coating covered by a release strip, the flaps being foldable in the opposite direction about the flap fold lines, the reply envelope being sealed by removing the flap release strip and adhering the flaps over the first face of the second portion with the recipient address indicia on the second face of the second portion being exposed.

2. An envelope that evolves into a reply envelope in accordance with claim 1 wherein the document comprises an invoice or other indication of payment due and the reply document comprises a check or other form of monetary payment transmittal.

* * * * *